United States Patent [19]

Curley

[11] 4,050,758

[45] Sept. 27, 1977

[54] ZERO INSERTION FORCE CONNECTOR

[75] Inventor: James H. Curley, Costa Mesa, Calif.

[73] Assignee: International Telephone and Telegraph Corporation, New York, N.Y.

[21] Appl. No.: 742,700

[22] Filed: Nov. 17, 1976

[51] Int. Cl.[2] ..... H01R 13/62

[52] U.S. Cl. ..... 339/74 R; 339/176 M; 339/176 MP

[58] Field of Search ..... 339/17 L, 17 LM, 44 R, 339/44 M, 74, 75 M, 75 MP, 176 M, 176 MP, 176 MF

[56] References Cited

U.S. PATENT DOCUMENTS

| | | | |
|---|---|---|---|
| 3,395,377 | 7/1968 | Straus | 339/176 MP |
| 3,897,991 | 8/1975 | Pritulsky | 339/75 MP |
| 3,963,317 | 6/1976 | Eigenbrode | 339/74 R |
| 3,997,231 | 12/1976 | Sherwood | 339/176 MP |

FOREIGN PATENT DOCUMENTS

| | | | |
|---|---|---|---|
| 2,275,964 | 1/1976 | France | 339/74 R |

OTHER PUBLICATIONS

Brearley, Latchable Contact Card-to-Board Connector, IBM Technical Disclosure Bulletin, vol. 3, No. 9, p. 2590, Feb. 1971.

*Primary Examiner*—Roy Lake
*Assistant Examiner*—Mark S. Bicks
*Attorney, Agent, or Firm*—Thomas L. Peterson

[57] ABSTRACT

An electrical connector in which two rows of resilient contacts are mounted in a connector housing which is adapted to receive therein conductors on an electrical component that are desired to be engaged by the contacts. The contacts have spring contacting portions which extend resiliently toward a center wall in the housing. Means is provided for retracting the contacts away from the center wall so that the conductors on the electrical component may be inserted into the connector housing with zero insertion force. Such retracting means includes laterally extending fingers pivotally connected to the center wall. The contacting portions of the contacts extend through vertical openings in the fingers. A cam actuator underlies the ends of the fingers. Longitudinal movement of the cam actuator raises the fingers, whereby the contacts are cammed outwardly away from the center wall in the housing.

10 Claims, 7 Drawing Figures

ZERO INSERTION FORCE CONNECTOR

BACKGROUND OF THE INVENTION

This invention relates generally to an electrical connector and, more particularly, to a zero insertion force electrical connector having cam means therein for actuating the contacts out of engagement with conductors on an electrical component.

It is well known in the art that substantial force is required to insert a printed circuit board into a connector having a large number of spring contacts therein due to the resilient engaging force of the contacts with the edge of the board. As the number of contacts is increased in a connector, the amount of force required to insert the printed circuit board into the connector, or to withdraw it from the connector, may become excessive for practical use. In addition, the direct insertion of boards into connectors having spring contacts therein results in a wiping action occurring between the contacts and the pads on the edge of the board, which causes excessive wear of the pads over lengthy periods of use of the connector. It is, therefore, a common practice in the art to provide a zero insertion force printed circuit board connector in which the contacts are mounted so that they are out of the path of movement of the board when it is inserted into the connector whereby no resistance is encountered upon inserting the board thereinto. Thereafter the contacts are cam actuated into engagement with the pads on the edge of the board. When it is desired to remove the board from the connector, the cam actuation mechanism is released so that the contacts are no longer frictionally engaging the pads on the board, thus allowing the board to be freely removed from the connector. U.S. Pat. No. 3,526,869 discloses a zero force printed circuit board connector in which a rotatable cam pushes a longitudinally movable slide cam element that cams the contacts into engagement with the pads on a printed circuit board inserted into the connector. U.S. Pat. No. 3,478,301 discloses a zero force printed circuit board connector in which the board actuates cam blocks in the connector which in turn cam the contacts into engagement with the board when the board is inserted into the connector. It is also known in the art to provide a zero force printed circuit board connector in which a movable cam on the connector housing acts directly upon the contacts to actuate them. Examples of these connectors are found in the following U.S. Pat. Nos. 3,475,717; 3,329,926; and 3,568,134.

U.S. Pat. No. 3,818,419 to Crane discloses a zero insertion force printed circuit board connector in which separate spring elements are mounted in the connector housing for resiliently urging two rows of contacts into engagement with a printed circuit board mounted in a central slot in the housing. A cam actuator is provided for retracting the contacts away from the printed circuit board so that the board may be withdrawn and inserted into the connector housing with zero insertion force. Thus, in contrast to the other connectors discussed herein, in the Crane connector cam actuation of the contacts opens the contacts rather than closes the contacts.

The general principles discussed above with respect to zero insertion force electrical connectors has also been applied to other forms of electrical connectors in which individual electrical contacts on an electrical component are inserted into a connector housing having cam actuated contacts. The purpose of the present invention is to provide a cam actuator zero insertion force connector in which actuation of the contacts serves to open contacts in a manner similar to that disclosed in the aforementioned Crane patent, however, with a significantly different contact shifting arrangement which allows the contacts to be actuated with lower force.

SUMMARY OF THE INVENTION

According to the principal aspect of the present invention, there is provided a zero insertion force electrical connector in which a row of contacts is mounted in an elongated insulative housing. The housing is open to the top for receiving therein conductors on an electrical component, such as individual conductor pins on a mating connector assembly or conductive pads on the edge of a printed circuit board. The housing includes walls on opposite sides of the row of contacts. The contacts have spring contacting portions which extend resiliently toward a vertical plane that passes through one wall for engaging the conductors inserted into the housing. Means is provided for retracting the contacting portions of the contacts away from said plane so that the conductors may be inserted into and withdrawn from the connector with zero force. Such retracting means includes contact shifting means and cam actuator means. The contact shifting means has a hinged connection to said one wall for vertical pivotal movement between lower and upper positions. The contact shifting means embodies cam surface means for retracting the contacting portions of the contacts away from said vertical plane when moved from the lower position to the upper position. The cam actuator means is operable to move the contact shifting means from said lower position to said upper position. Preferably, the cam actuator means engages the outer free ends of the contact shifting means so that a relatively high leverage force is applied to the contacts by the cam surface means upon raising of the contact shifting means, thereby permitting the contacts to be actuated with only a minimum amount of force.

DESCRIPTION OF THE PREFERRED EMBODIMENTS

Figure 1:
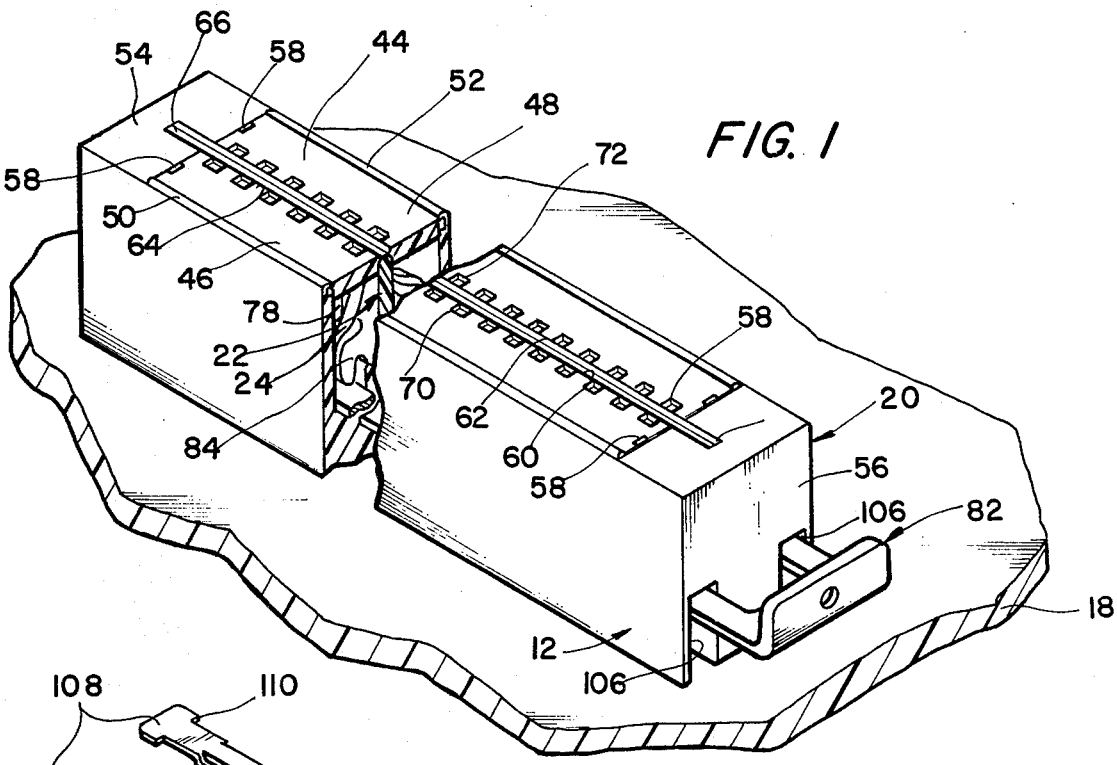
FIG. 1 is a perspective view of an electrical connector assembly embodying the novel connector of the present invention, with a portion of the connector housing broken away to show details of its interior structure.

Referring now to FIG. 1 of the drawings in detail, there is illustrated an electrical connector assembly in accordance with the present invention, generally designated 10. Basically, the connector assembly 10 comprises a connector housing, generally designated 12, containing two rows of contacts 14 and 16 which are mounted in a planar mounting member 18. The housing 12 consists of an outer elongated insulative housing 20 and an elongated inner housing 22.

Figure 4:
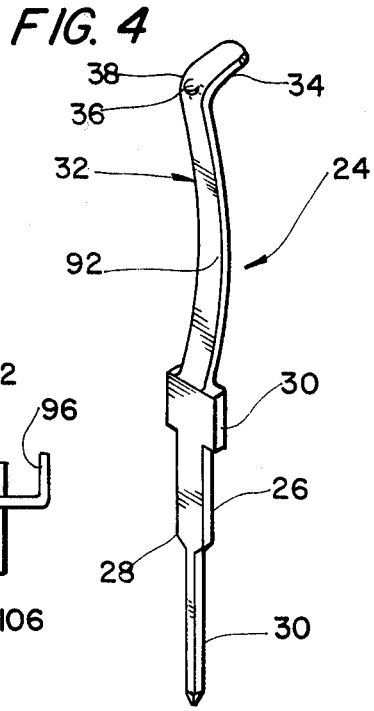
FIG. 4 is a perspective view of one of the contacts employed in the connector of the invention.

Reference is made to FIG. 4, which shows one of the contacts used in the connector, generally designated 24. It is understood that the contacts in the respective rows of contacts 14 and 16 are identical and the following description with respect to contact 24 applies to the contacts in each row. The contact 24 has a lower mounting portion 26 which tapers downwardly at 28 to a wire-wrap tail or post 30. A shoulder 30 is located above the mounting portion 26 of the contact. The section 32 of the contact above the shoulder 30 is coined to a reduced thickness to provide a bowed shaped spring contacting portion. The upper part 34 of the bowed spring contacting portion 32 is reversely bent and a proturberance 36 is provided on the convex upper region 38 of the spring contacting portion 32 which provides a high unit force with a conductor to be inserted into the connector housing.

The planar mounting member 18 is preferably in the form of a printed circuit board having two rows of plated-through holes designated 38 and 39. The lower mounting portions 26 of the contacts in the two rows 14 and 16 are press fit into the holes 38 and 39 in a manner well known in the art. Alternatively, the mounting portions of the contacts could be soldered in the holes or otherwise mounted therein to make electrical connection with conductive traces, not shown, on the printed circuit board.

The outer housing 20 is in the form of a hollow shell which is mounted over the two rows of contacts 14 and 16 and secured to the printed circuit board 18 in any suitable fashion, such as by direct connection to the board or by frictional engagement of the inner housing 22, which is suitably retained in the outer housing, with the contact shoulders 30.

Figure 2:
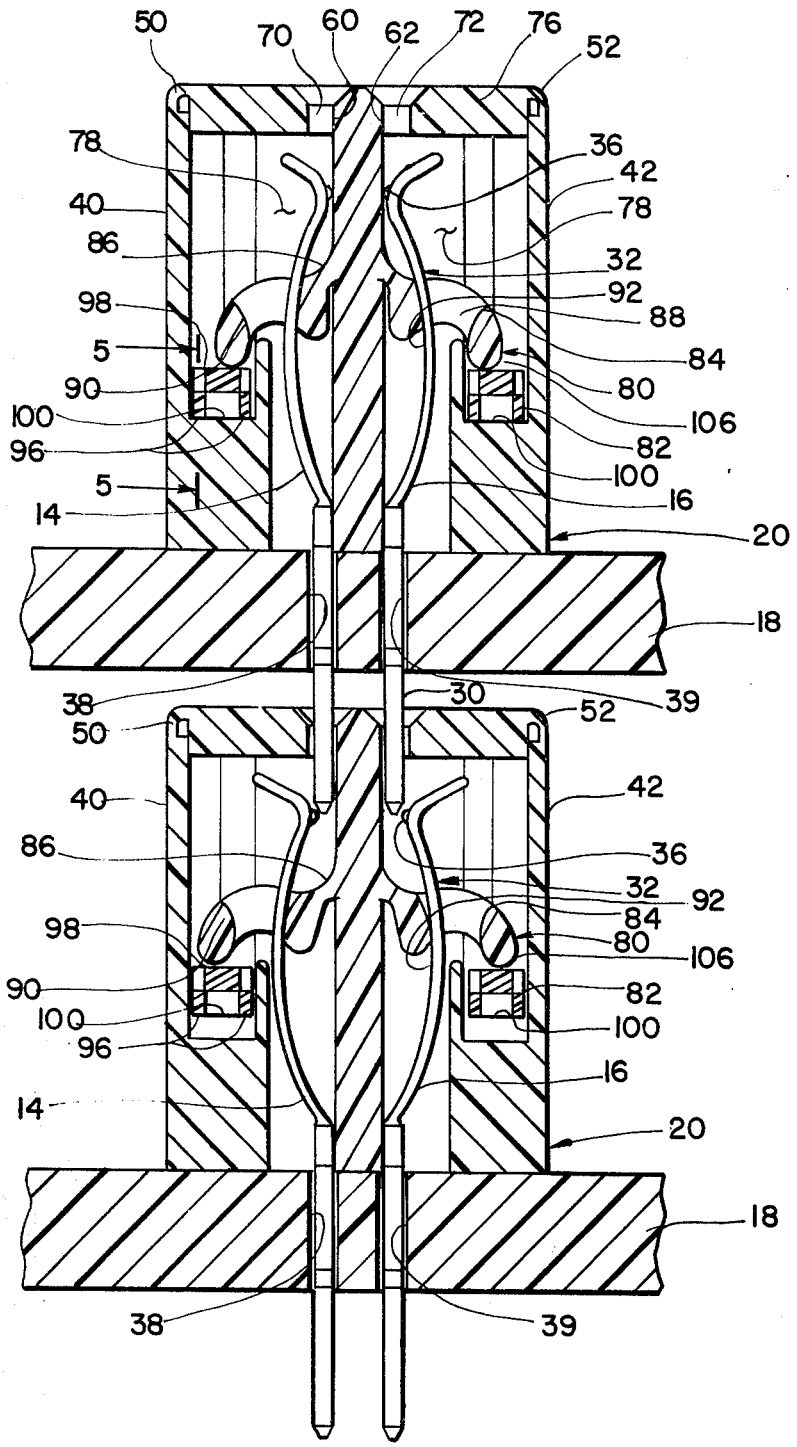
FIG. 2 is a vertical sectional view of a pair of electrical connector assemblies as illustrated in FIG. 1 mounted in a stacked arrangement and partially interengaged with each other, the contacts in the upper connector being illustrated in their unactuated, closed position while the contacts in the lower connector are illustrated in their actuated, open position.

The outer housing has two vertical parallel sidewalls 40 and 42 and an upper wall 44 which extends over the top of the two rows of contacts 14 and 16. The upper wall is divided lengthwise into two independent half sections 46 and 48. The half sections are pivotally connected at their outer edges to the corresponding sidewalls 40, 42 of the connector housing by integral thin hinge portions 50 and 52, respectively. The upper wall sections 46 and 48 extend between end sections 54 and 56 of the connector housing which are integral with the sidewalls 40 and 42. Latching elements 58 at the opposite ends of the upper wall sections 46 and 48 serve to releasably retain the wall sections in their closed position as illustrated in FIGS. 1 and 2, for example. The pivotally mounted upper wall sections 46 and 48 may be independently lifted in order to permit access to the interior of the housing so that contacts may be replaced if they become damaged during use of the connector.

The inner edges 60 and 62 of the upper wall sections 46 and 48, respectively, are spaced laterally apart to define a longitudinally extending slot 64 in the upper wall of the housing. Vertical grooves 66 and 68 are formed in the end sections 54 and 56 of the outer housing in alignment with the slots 64. Two rows of apertures 70 and 72 are formed along edges 60 and 62 of the upper wall sections 46 and 48, respectively. The apertures in each row are aligned with each other and overlie the contacts in the two rows of contacts 14 and 16.

The inner housing 22 of the connector comprises a vertical center wall 74 which is positioned intermediate the sidewalls 40 and 42 of the outer housing. The opposite ends of the center wall 74 are slidably fitted in the vertical grooves 66 and 68 in the end sections of the outer housing. The upper portion 76 of the center wall 74 extends into the slot 64 and its opposite sides lie along the edges 60 and 62 of the two half sections 46 and 48 of the upper wall.

The inner housing 22 also includes a plurality of longitudinally spaced laterally extending walls 78 on opposite sides of the center wall 74. The walls 78 are disposed between each adjacent pair of contacts in the two rows of contacts 14 and 16 so as to provide insulative barriers between the contacts.

The spring contacting portions 32 of the contacts in the two rows 14 and 16 are arranged so that they extend resiliently toward the center wall 74. Preferably, in the relaxed or unactuated position of the spring contacting portions of the contacts, as shown in the upper connector assembly illustrated in FIG. 2, the contacting protuberances 36 on the contacts just engage the sides of the center wall 74 of the inner housing. Thus, the contacts are normally in a closed position. In order to permit conductive posts of a second connector assembly to be mounted in the connector of the present invention with zero insertion force, means is required for retracting the spring contacting portions 32 of the contacts away from the center wall 74. Such means includes contact shifting means, generally designated 80, and a cam actuator, generally designated 82.

The contact shifting means consists of a plurality of fingers 84 extending laterally outwardly from the opposite sides of the center wall 74. A finger is provided for each of the contacts 24 and is located between the lateral separating walls 78 of the inner housing. Each finger is pivotally connected to the center wall 74 by an integral hinge section 86. The fingers are vertically movable from a lower unactuated position, as shown in the upper connector assembly illustrated in FIG. 2, to an upper actuated position, as shown in the lower connector assembly illustrated in FIG. 2. Each finger embodies a vertical opening 88 through which the spring contacting portion 32 of its corresponding contact extends. The opening is dimensioned so that the contacting portion 32 of the contact is loose in the opening and thus is free to move laterally upon upward movement of the finger. The inner wall 90 of each opening 88 closest to the center wall 74 provides an arcuate cam surface which cooperates with the concave inner surface 92 of the contact 24 so that when the finger 84 pivots upwardly, the cam surface will retract the contacting protuberance 36 away from the center wall a sufficient distance so that a post 30 inserted through an opening 70 or 72 will enter into the space between the center wall and the contact with zero insertion force as seen in the lower connector assembly illustrated in FIG. 2.

Figure 6:
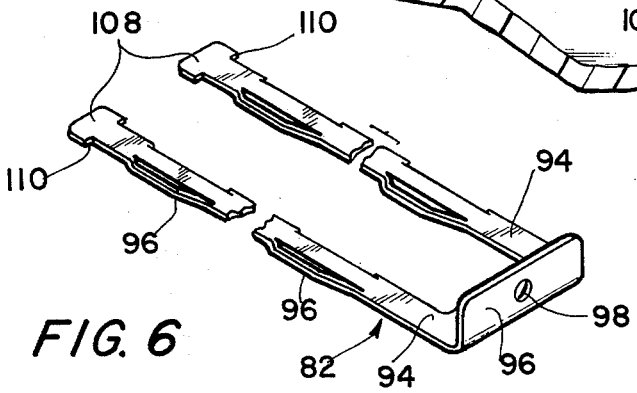
FIG. 6 is a perspective view of the cam actuator illustrated in FIG. 5.
Figure 5:
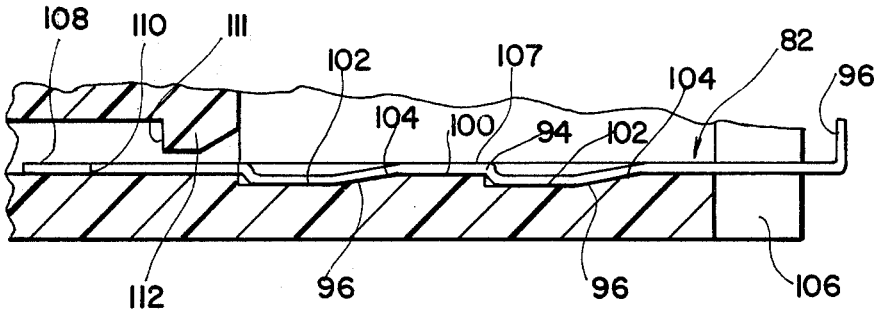
FIG. 5 is a longitudinal sectional view taken along line 5—5 of FIG. 2, showing how the cam actuator of the connector assembly cooperates with the cam surface on the connector housing.
Figure 3:
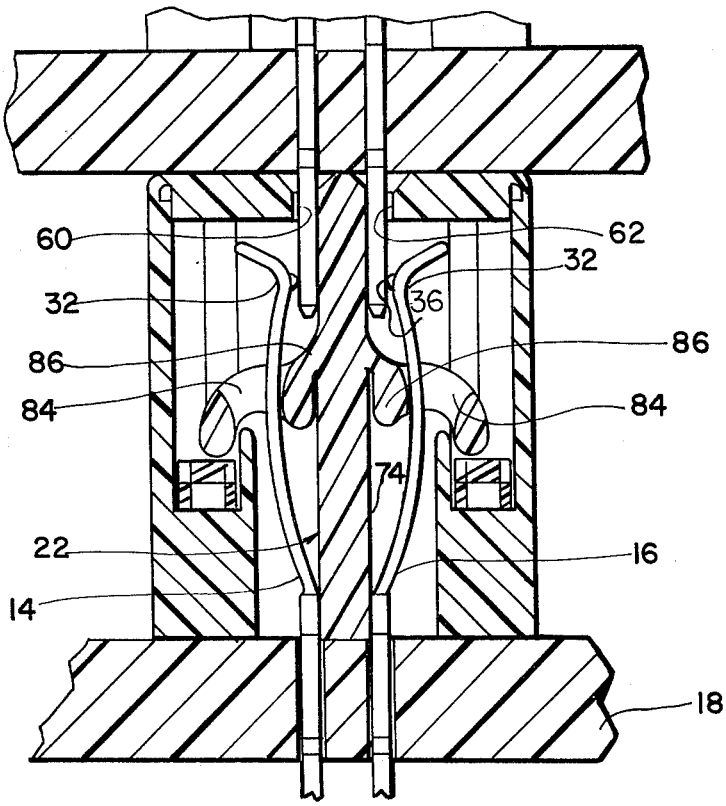
FIG. 3 is a vertical sectional view similar to FIG. 2 showing the lower connector assembly and only the lower part of the upper connector assembly, with the contacts in the upper connector fully inserted into the lower connector in which the contacts are in their unactuated, closed position.

The cam actuator 82 serves to raise the fingers 84 on the inner housing of the connector to actuate the contacts to their open position. As best seen in FIG. 6, the cam actuator comprises a pair of elongated parallel elements 94 which are joined at one end by a vertical plate 96 having a hole 98 therein. The edge portions of each element 94 are deformed downwardly at two longitudinally spaced positions to provide two pairs of downwardly facing inclined ramps 96 on each element. Upwardly facing elongated channels 100 are formed on the inside of the sidewalls 40 and 46 of the outer housing 20. The channels are spaced apart a distance corresponding to the lateral spacing between the elongated elements 94 of the cam actuator and are dimensioned to slidably receive such elements therein. As seen in FIG. 1, the plate 96 of the cam actuator extends outside of the connector housing 12 where it is accessible to the operator to effect longitudinal sliding movement of the cam actuator in the housing. As seen in FIG. 5, the bottom of each channel 100 is formed with a pair of recesses 102. The recesses are shaped to provide inclined ramps 104 disposed at an angle corresponding to the angle of the inclined ramps 96 on the cam actuator. It will be appreciated that when the cam actuator is pulled outwardly from the connector housing from the position shown in full lines to that illustrated in dotted lines in FIG. 1, the ramps 96 and 104 on the cam actuator and outer connector housing will cooperate to raise the actuator 82 in the channels 100. The outer free ends 106 of the fingers 84 on the inner housing engage the upper flat surfaces 107 of the elongated elements 94 of the cam actuator. Thus, when the actuator elements 94 rise in the channels 100 when the actuator is shifted outwardly of the connector housing in the manner just described, the fingers 84 will pivot upwardly in a smooth and uniform manner to the position shown in the connector assembly illustrated in the bottom half of FIG. 2, simultaneously shifting the contacts 24 in the two rows 14 and 16 to their open position, whereupon the posts 30 in the upper connector assembly may be inserted fully into the lower connector member with zero force. Once the upper and lower connector members are fully assembled in a stacked arrangement, the cam actuator is pushed back into the connector housing to the position shown in full lines in FIG. 1, whereupon the spring contacting portions 32 of the contacts, due to their inherent resiliency, will move inwardly toward the center wall 74 of the inner housing to resiliently engage the posts 30, as seen in FIG. 3. In summary, actuation of the contacts serves to retract the contacts out of engaging position so that the posts 30 on the upper connector assembly may be freely inserted into the lower connector assembly, and thereafter the cam actuator 82 is returned to its inner position in the connector housing whereupon the spring contacting portions of the contacts 24 will return to their normal closed position to engage the posts.

The hinge sections 86 joining the fingers 84 to the wall 74 possess memory characteristics causing the fingers to return to their lower position as illustrated in FIG. 3 after the cam actuator has been returned to its unactuated position. The fingers, therefore, serve to resiliently retain the cam actuator in the channels 100 of the outer connector housing. It will be appreciated that by the present invention, any number of printed circuit board connector assemblies 10 may be mounted in stacked relationship with the contact posts of each connector housing extending into the connector on the lower adjacent assembly.

To assemble the parts of each connector assembly 10, the contacts 24 are first press fit into the plated-through holes 38 and 39 in the printed circuit board 18. Thereafter, the outer connector housing 20 is mounted over the contacts. The upper wall sections 46 and 48 are pivoted open and the cam actuator 82 is inserted into the outer housing through slots 106 in the end section 56 of the housing. Preferably, enlarged heads 108 are formed on the free ends of elongated elements 94 of the cam actuator. The heads define rearwardly facing shoulders 110. These shoulders are adapted to engage shoulders 111 (only one being visible in FIG. 5) in the channels 100 facing in the direction of the end section 54 of the connector in order to limit outward movement of the cam actuator 82 in the connector housing. The shoulders 111 are formed on projection 112 spaced above the bottoms of the channels 100. The cam actuator may be inserted into the connector housing at a slight vertical angle in order to allow the heads 108 on the elements 94 to be inserted underneath the projections and, therefore, behind the aforementioned shoulders 111 on the interior of the housing. After the elements 94 are seated in the channels 100, the inner housing 92 is inserted into the outer housing. The inner housing is inserted into the outer housing by aligning the ends of the center wall 74 with the vertical grooves 66 and 68 in the end sections of the outer housing and pushing the inner housing downwardly until it is fully seated within the outer housing. As stated previously, the fingers 84 on the inner housing serve to bias the cam actuator downwardly in the channels 100. The upper sections 46 and 48 of the outer housing are then shifted to their closed position, as seen in the drawings, and are retained in that position by the latches 58. The latches may be simple friction latches or releasable spring tines, not shown.

It will be appreciated that by the present invention, longitudinal movement of the cam actuator causes the actuator to rise in the channels 100. Since the cam actuator elements 94 engage the free ends of the fingers 84, the fingers will be raised with a high leverage force, thereby allowing the contacts to be shifted to an open position with a minimum amount of force applied to the cam actuator.

Figure 7:
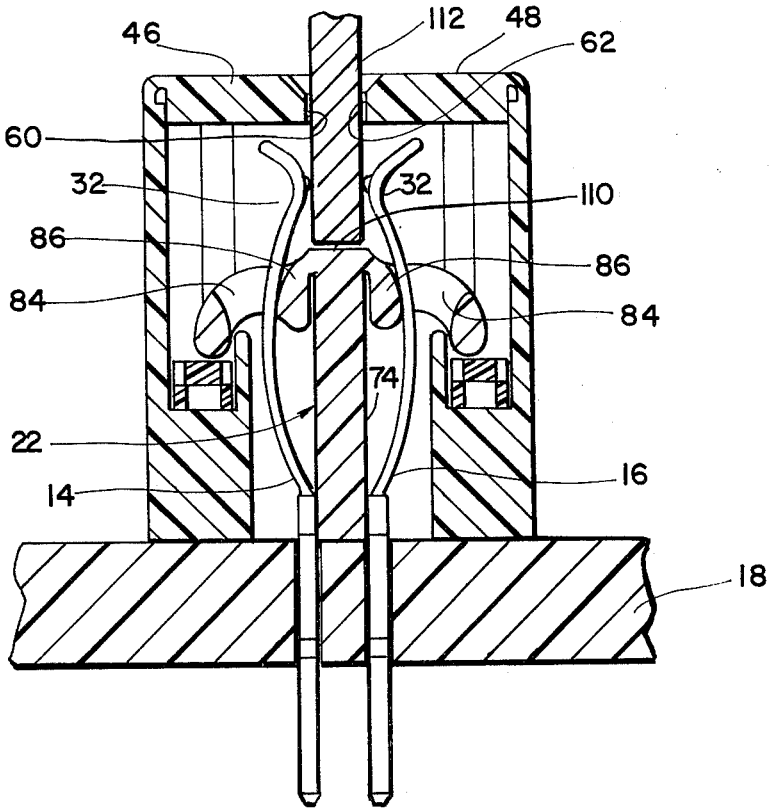
FIG. 7 is a vertical sectional view through an alternative form of the connector assembly of the present invention which receives a printed circuit board, with the contacts shown in their unactuated, closed position.

Reference is made to FIG. 7 which illustrates an alternative embodiment of the invention which is identical to the first embodiment disclosed herein except that the upper portion 76 of the center wall 74 of the inner housing 22 is eliminated so that the inner wall terminates in an upwardly facing surface 110 immediately adjacent to the hinge sections 86 for the fingers 84. In addition, the apertures 70 and 72 in the upper wall sections 46 and 48 employed in the first embodiment are eliminated and the edges 60 and 62 of the upper wall sections 46 and 48 are spaced apart a distance sufficient to allow a printed circuit board 112 to be inserted into the space between the contacting portions 32 of the two rows of contacts 14 and 16. Otherwise, the printed circuit board connector illustrated in FIG. 7 has the same structural features and functions in the same manner as the connector assemblies illustrated in FIGS. 1 to 6. Other modifications are variations of the invention will be apparent to those skilled in the art.

What is claimed is:

1. A zero insertion force electrical connector comprising:

an elongated insulative housing having a row of contacts therein, said housing being open to the top for receiving therein conductors on an electrical component;

said housing including walls on opposite sides of said row of contacts;

said contacts having spring contacting portions extending resiliently toward a vertical plane passing through one of said walls for engaging said conductors inserted into said housing;

means for retracting said contacting portions away from said vertical plane;

said retracting means comprising contact shifting means and cam actuator means, said contact shifting means having a hinged connection to said one wall and a free end adjacent to the other of said walls for vertical pivotal movement between a lower position and an upper position;

said contact shifting means embodying cam surface means for retracting said contacting portions of said contacts away from said vertical plane when moved from said lower position to said upper position; and said cam actuator means being operable to move said contact shifting means from said lower position to said upper position, said cam actuator means comprising an elongated element underlying said free end of said cam shifting means and being mounted for longitudinal sliding movement in said housing.

2. An electrical connector as set forth in claim 1 wherein:

said cam shifting means has a plurality of vertical openings therethrough each loosely receiving the contacting portion of one of said contacts therein.

3. An electrical connector as set forth in claim 2 wherein:

said cam surface means is formed on the walls of said openings.

4. An electrical connector as set forth in claim 2 wherein:

said cam surface means is formed on the walls of said openings closest to said one wall.

5. An electrical connector as set forth in claim 2 wherein:

said cam shifting means comprises a plurality of contact shifting fingers one for each of said contacts, each of said fingers embodying one of said contact receiving vertical openings.

6. An electrical connector as set forth in claim 1 wherein:

said cam shifting means comprises a plurality of contact shifting fingers one for each of said contacts;

a vertical opening in each of said fingers loosely receiving the contacting portion for a corresponding contact therethrough; and said cam surface means being formed on the wall of each of said openings closest to said one wall.

7. An electrical connector as set forth in claim 1 including:

a planar mounting member;

said contacts having lower mounting portions mounted in said mounting member; and said housing comprises a hollow shell mounted over said contacts onto said mounting member.

8. A zero insertion force electrical connector comprising:

an elongated housing having two rows of contacts therein, said housing having an upper wall extending over said rows of contacts;

aperture means in said upper wall above said two rows of contacts adapted to receive therein conductors on an electrical component to be engaged by said contacts;

an inner vertically extending wall between said rows of contacts;

said contacts having spring contacting portions extending resiliently toward a vertical plane passing through said inner wall for engaging said conductors;

means for retracting said contacting portions away from said vertical plane;

said retracting means comprising a pair of contact shifting means extending laterally outwardly from opposite sides of said inner wall and cam actuator means, each said contact shifting means having a hinged connection to said inner wall and a free end for vertical pivotal movement between a lower position and an upper position;

each of said contact shifting means embodying cam surface means for retracting said contacting portions of said contacts away from said vertical plane when moved from said lower position to said upper position; and said cam actuator means underlying said free ends of said contact shifting means and being operable to move said contact shifting means from said lower position to said upper position.

9. An electrical connector as set forth in claim 8 wherein:

said housing has two sidewalls; and said upper wall is divided lengthwise into two independent sections, said sections having hinged connections to said sidewalls so that either section may be lifted to permit access to a row of contacts.

10. An electrical connector as set forth in claim 9 wherein:

said inner wall is slidably mounted in said housing.

* * * * *